United States Patent [19]

Salusinszky

[11] Patent Number: 4,806,230

[45] Date of Patent: Feb. 21, 1989

[54] UPGRADING NAPHTHA WITH MATCHED CATALYST(S)

[75] Inventor: Andor L. Salusinszky, Burwood, Australia

[73] Assignee: Royal Melbourne Institute of Technology Limited, Melbourne, Australia

[21] Appl. No.: 934,863

[22] Filed: Nov. 25, 1986

[30] Foreign Application Priority Data

Nov. 29, 1985 [AU] Australia ..... PH3656

[51] Int. Cl.[4] ..... C10G 35/06

[52] U.S. Cl. ..... 208/64; 208/65; 208/135; 585/417

[58] Field of Search ..... 585/417; 208/64, 65, 208/135

[56] References Cited

U.S. PATENT DOCUMENTS

| | | | |
|---|---|---|---|
| 3,950,241 | 4/1976 | Bonacci et al. | 208/65 |
| 4,190,519 | 2/1980 | Miller et al. | 208/65 |
| 4,350,835 | 9/1982 | Chester et al. | 585/417 |
| 4,443,326 | 4/1984 | Field | 208/134 |
| 4,590,323 | 5/1986 | Chu | 585/417 |
| 4,664,781 | 5/1987 | Unmuth et al. | 208/138 |

*Primary Examiner*—Curtis R. Davis

*Attorney, Agent, or Firm*—Birch, Stewart, Kolasch & Birch

[57] ABSTRACT

A process for the upgrading of a hydrocarbon feedstock which includes providing a feedstock including $C_4$ and higher hydrocarbons which include paraffins and cycloparaffinic hydrocarbons;

contacting the feedstock with a conventional naphtha reforming catalyst at an elevated temperature and at a liquid hourly space velocity (LHSV) of greater than approximately 5, when the cycloparaffin content is approximately 10% by weight or greater;

and contacting the feedstock with a metal-containing ZSM-5 type zeolite catalyst at an elevated temperature at approximately 0.5 to 2 LHSV when the initial cycloparaffin content is reduced to less than approximately 10% by weight, and solely with a metal-containing ZSM-5 type zeolite catalyst at an elevated temperature at approximately 0.2 to 2 LHSV when the initial cycloparaffin content is less than approximately 10% by weight.

20 Claims, No Drawings

UPGRADING NAPHTHA WITH MATCHED CATALYST(S)

BACKGROUND OF THE INVENTION

This invention relates generally to upgrading a hydrocarbon feedstock in order to improve the octane rating and/or volatility of the feedstock.

Processes for the upgrading of naphtha are known under the name of "Catalytic Reforming". In these processes usually heavy naphtha, that is naphtha from which $C_5$paraffins and some of the $C_6$ components have been removed by distillation, is contacted at high temperatures and under high hydrogen partial pressure with a catalyst which contains usually platinum on aluminum oxide or platinum with a second metal on a similar base.

Platinum or a combination of platinum with another metal, deposited on an acidic aluminum oxide base is called a bifunctional catalyst because it has a metal and an acidic function. These two functions combined, catalyze several reactions of the various compounds of naphtha which occur more or less simultaneously. The main reactions are the following:

(i) cycloparaffins are dehydrogenated to aromatics, this is a very fast endothermic reaction;

(ii) cycloparaffins and paraffins are isomerised to equilibrium, this is a slower reaction than (i) and thermally neutral;

(iii) normal-paraffins and isoparaffins are dehydrocyclised to aromatics, this reaction is even slower than reaction (ii) mainly in the case of normal-paraffins and is also endothermic while (iv) normal-paraffins and isoparaffins are hydrocracked to lower molecular weight paraffins, this reaction takes place along with reaction (iii) but is exothermic.

Reactions (i) and (iv) for optimum performance require different, in some cases even opposing, conditions. For instance reactions (i), and also (iii) are producing hydrogen so equilibrium would be shifted in the desired direction if hydrogen concentration is kept low while in contrast, hydrocracking (reaction (iv)) requires high hydrogen partial pressure.

In addition, the reaction rate of reaction (i) is approximately 100 times that of reaction (iv). Furthermore one catalyst, even if it is bimetallic and/or bifunctional, cannot be optimum for all the reactions involved. In addition platinum catalysts are known to be relatively selective toward isoparaffins, that is they calalyze the reaction of branched compounds in preference. These branched paraffins are more valuable as blendstocks for the preparation of engine fuels than the normal paraffins which react more slowly in the presence of platinum catalysts. A further disadvantage of the known catalytic reforming processes is that pentanes and hexanes usually pass through the reactor without reaction or can only be hydrocracked to gases which reduce liquid yield.

Summary of the Invention

Accordingly, it is an object of the present invention to overcome, or at least alleviate, one or more of the difficulties related to the prior art.

Accordingly, in a first aspect there is provided a process for the upgrading of a hydrocarbon feedstock which includes providing a feedstock including $C_4$ and higher hydrocarbons including paraffins and cycloparaffinic hydrocarbons;

contacting the feedstock with a conventional naphtha reforming catalyst at an elevated temperature and at a liquid hourly space velocity (LHSV) of greater than approximately 5, when the cycloparaffin content is approximately 10% by weight or greater;

and contacting the feedstock with a metal-containing ZSM-5 type zeolite catalyst at an elevated temperature at approximately 0.5 to 2 LHSV when the initial cycloparaffin content is reduced to less than approximately 10% by weight, and solely with a metal-containing ZSM-5 type zeolite catalyst at an elevated temperature at approximately 0.2 to 2 LHSV when the initial cycloparaffin content is less than approximately 10% by weight.

It will be understood that the upgrading of the feedstock is achieved substantially by the dehydrogenation of the paraffins and cycloparaffins to aromatics.

The hydrocarbon feedstock may be a full naphtha.

Preferably the ZSM-5 type zeolite catalyst treatment is conducted at a temperature of from approximately 400° to 650° C. and at a liquid hourly space velocity of from approximately 0.5 to 1.

Preferably in the preliminary step the conventional naphtha reforming catalyst is selected from catalysts containing a platinum group metal, or a combination of a platinum and another metal, on an acidic aluminum oxide base.

Preferably the ratio of the ZSM-5 type catalyst to the conventional naphtha reforming catalyst is at least 5, preferably greater than 20.

The term "platinum group metal" as used herein includes platinum, palladium, osmium, iridium, ruthenium, rhodium or mixtures thereof. Platinum and rhodium are preferred. Other metals which may be included may include Group VII-B metals including rhenium.

Preferably the process is conducted with the reforming catalyst at temperatures of 300° to 400° C. and with a ZSM-5 type catalyst at temperatures of 400° to 600° C.

It has been found that metal-containing ZSM-5 type zeolite catalysts which may be used according to the present invention include ZSM-5, ZSM-11, ZSM-12, ZSM-35, ZSM-38 and other similar materials. The catalyst may have deposited therein a suitable metal. A metal selected from zinc and gallium groups of the Periodic Table of the Elements, may be used. Zinc or gallium is preferred. ZSM-5 type zeolite catalysts are not only catalytically selective but also shape selective, so that they preferably calalyze the reaction of normal-paraffins. An additional advantage of zeolites is that they also calalyze the dehydrogenation of $C_3$ to $C_6$paraffins.

Both conventional reforming catalysts and zeolites calalyze hydrocracking reactions. However, if zeolites are used for reaction (iii) above due to their shape selectivity their effect may reduce the requirement for hydrocracking or may render it unnecessary. This has the advantage that less hydrogen recycle or no hydrogen recycle at all is necessary.

The reduction or elimination of hydrocracking changes the thermal balance of the process. Conventional catalytic reforming is overall endothermic but the high heat requirements of reactions (i) and (iii) are partly balanced by the exothermic hydrocracking reactions (iv). So the process can be carried out in adiabatic reactors although with reheating between reactors.

The dehydrogenation of paraffins, the main reaction promoted by ZSM-5 type catalyst, is highly endothermic. Therefore the process of the invention is preferably carried out under approximately isothermal conditions. This means the application of a tubular reactor. The reactor tubes may be arranged in a combustion chamber where temperature can be controlled by controlling firing rate and/or flue gas recirculation. Preferably two or more tubular reactors are used with one tubular reactor in conversion service while in the other reactor(s) the catalyst is regenerated. The dehydrogenation of cycloparaffins in the presence of a conventional reforming catalyst containing platinum can be carried out in an diabatic or an isothermal reactor but for the dehydrogenation of paraffins with ZSM-5 catalyst the isothermal route is preferred.

In accordance with the process of the present invention naphthas containing significant portion of cycloparaffins, for example more than aproximately 10 to 50 mol. % may be first contacted with a conventional reforming catalyst. But instead of the usually applied liquid hourly space velocity (LHSV) of 1 to 3, a LHSV exceeding 5, preferably 20 to 50 or greater may be used in view of the high rate of the cycloparaffin dehydrogenation reaction. As a further difference from conventional catalytic reforming no high hydrogen partial pressure is needed and hydrogen recycle can be reduced or even eliminated.

In most cases, dehydrogenation of the cycloparaffin content of a naphtha will not provide sufficient octane uplift. In these cases in a second stage dehydrocyclisation of the paraffins, including the normal-paraffins, can be achieved with a metal containing ZSM-5 type catalyst. In contrast to conventional reforming, the $C_4/C_6$ part of the naphtha can be treated together with the higher molecular weight part. Again in comparison to conventional catalytic reforming, reduced hydrogen recycle is only required or, in most cases, no hydrogen recycle at all is necessary.

In the case of "naphthenic" naphtha, that is naphtha with relatively high cycloparaffin content, the two-stage dehydrogenation can be carried to an extent which satisfies octane increase requirements. Accordingly no hydrocracking of paraffins is necessary although some may occur, mainly in the second stage.

In the case of highly paraffinic naphthas, for instance reformates from which aromatics have been extracted, the second stage, as described above, in itself would usually ensure the required octane increase.

The advantages of the process in accordance with the invention are mainly:

(1) lower noble metal catalyst inventory;

(2) low or eliminated hydrogen recycle.

A further advantage, due to the minimization or elimination of hydrocracking, is that temperature and pressure in the system can be maintained at a lower level than in conventional catalytic reforming.

The invention will now be more fully described with reference to the following examples. It will be appreciated, however, that the following examples are illustrative only and should not be taken as a restriction on the generality of the invention as described above.

EXAMPLE 1

A Central Australian naphtha has the following characteristics:

| | Wt. % |
|---|---|
| Normal-paraffins | 48.5 |
| Isoparaffins | 30.2 |
| Naphthenes | 9.0 |
| Aromatics | 5.5 |
| Unidentified | 6.7 |
| The boiling range of the naphtha is: | |
| | °C. |
| IBP | 32 |
| 10% | 63 |
| 50% | 122 |
| 90% | 176 |
| FBP | 203 |

Its RVP (Raid Vapor Pressure) is 8.3 psi and RON (Research Octane Number) clear 39. Due to the low naphthenes content of the naphtha a single catalyst favoring the dehydrogenation of paraffins is chosen.

The full naphtha is charged in a laboratory rig to a reactor filled with a zeolite catalyst. The zeolite is prepared in ways described in the literature for ZSM-5 and a zinc salt is deposited on it. Pressure in the reactor is marginally above atmospheric, temperature is maintained at 420° C., space velocity is controlled at 0.6 LHSV.

The reactor effluent is cooled to about 20° C., the liquid collected has the following chemical composition;

| | |
|---|---|
| Normal-paraffins | 13.2 |
| Isoparaffins | 15.9 |
| Naphthenes | 5.7 |
| Aromatics | 57.4 |
| Unidentified | 7.8 |

The quantity of liquid recovered is 58% by weight of the naphtha charged to the reactor. It has a calculated clear RON of 87 and a RVP of 1.5 psia.

EXAMPLE 2

A naphtha from an Australian off-shore oil field with a boiling range from 20° C. to 190° C. has the following characteristics:

| | Wt. % |
|---|---|
| Paraffins | 49.4 |
| Cycloparaffins | 42.7 |
| Aromatics | 7.9 |

The above naphtha is pumped continuously to a preheater at a rate of 50ml/hour where it is vaporized and heated to 450° C. The vapors from the preheater are passed through an isothermal reactor containing 1g of conventional reforming catalyst containing platinum and rhenium. After condensation the liquid recovered has the following characteristics:

| | Wt. % |
|---|---|
| Paraffins | 58.5 |
| Cycloparaffins | 2.5 |
| Aromatics | 39.0 |

EXAMPLE 3

The liquid product collected in Example 2 had charged to a reactor used in Example 1 and under similar conditions as described in Example 1. The product liquid removed contained by weight %

| | |
|---|---|
| Paraffins | 14.8 |
| Cycloparaffins | less than 1 |
| Aromatics | 85.2 |

The calculated RON exceeded 100 and RVP is 2.5 psia.

EXAMPLE 4

The same naphtha as used in Example 1 is charged to a reactor containing 1.1kg of ZSM-5 type catalyst doped with gallium. Temperature is maintained at 475° C. and the "liquid hourly space velocity" at 0.5. The liquid collected after condensation is 50.4 wt% of feed and contained 80.6 wt. % BTX (benzene, toluene xylenes). The gas phase contained 9.9 wt. % on feed of $H_2$ to $C_2$ whilst 39.7 wt.% is $C_3$ to $C_5$ paraffin hydrocarbons.

It will be understood from the foregoing that various alterations, modifications, and/or additions may be incorporated into the process without departing from the ambit of the present invention described herein.

I claim:

1. A process for the upgrading of a hydrocarbon feedstock which comprises:

providing a full naphtha hydrocarbon feedstock having an initial cycloparaffin content of less than approximately 10% by weight and contacting the provided feedstock with a metal-containing Z SM-5 type zeolite catalyst at an elevated temperature at approximately 0.2 to 2 LHSV so as to convert said full naphtha feedstock into an upgraded hydrocarbon product.

2. The process according to claim 1, wherein the provided feedstock is contacted at a temperature of 400° to 600° C. under approximately isothermal conditions.

3. The process according to claim 1, wherein said ZSM-5 type zeolite catalyst includes a metal selected from the group consisting of the zinc and gallium groups of the Periodic Table of the Elements.

4. The process according to claim 2, wherein the process is conducted in a tubular reactor.

5. The process according to claim 4, which comprises regenerating the catalyst, the regenerating being conducted in one or more tubular reactors.

6. The process according to claim 3, wherein said ZSM-5 type zeolite catalyst includes a metal selected from the group consisting of zinc and gallium.

7. The process according to claim 3, wherein the provided feedstock is contacted at a temperature of 400° to 600° C. under approximately isothermal conditions.

8. The process according to claim 6, wherein the provided feedstock is contacted at a temperature of 400° to 600° C. under approximately isothermal conditions.

9. A process for the upgrading of a hydrocarbon feedstock which comprises:

providing a full naphtha hydrocarbon feedstock having a cycloparaffin content of approximately 10% by weight or greater, contacting the provided feedstock with a naphtha reforming catalyst which comprises a platinum group metal at an elevated temperature and at a LHSV of greater than approximately 5 so as to reduce the cycloparaffin content of the provided feedstock to less than approximately 10% by weight and contacting the provided feedstock having the reduced cycloparaffin content with a metal-containing Z SM-5 type zeolite catalyst at an elevated temperature at approximately 0.5 to 2 LHSV so as to convert said full naphtha feedstock into an upgraded hydrocarbon product, wherein the reduction of the naphtha reforming catalyst and the conversion with the zeolite catalyst is conducted in a tubular reactor.

10. The process according to claim 9, wherein said ZSM-5 type zeolite catalyst includes a metal selected from the group consisting of the zinc and gallium groups of the Periodic Table of the Elements.

11. The process according to claim 9, wherein the ratio of said ZSM-5 type catalyst to said naphtha reforming catalyst is at least 5.

12. The process according to claim 11, wherein said ratio is at least 20.

13. The process according to claim 11, wherein the process is conducted with said reforming catalyst at temperatures of 300° to 400° C. and with said ZSM-5 type catalyst at temperatures of 400° to 600° C.

14. The process according to claim 9, wherein said full naphtha hydrocarbon feedstock is contacted with said naphtha reforming catalyst at approximately 20 to 50 LHSV.

15. The process according to claim 9, wherein the process comprising the two contacting steps are conducted under isothermal conditions.

16. The process according to claim 9, which comprises regenerating the zeolite catalyst, the regenerating being conducted in one or more tubular reactors.

17. The process according to claim 9, wherein said naphtha reforming catalyst contains an acidic aluminum oxide base and a metal selected from the group consisting of platinum, palladium, osmium, iridium, ruthenium, rhodium, rhenium, and mixtures thereof.

18. The process according to claim 17, wherein said naphtha reforming catalyst contains a metal selected from the group consisting of platinum and rhodium.

19. The process according to claim 10, wherein said ZSM-5 type zeolite catalyst includes a metal selected from the group consisting of zinc and gallium.

20. The process according to claim 9, wherein the provided feedstock is contacted with said zeolite catalyst at a temperature of approximately 400° to 650° C. at approximately 0.5 to 1 LHSV.

* * * * *